US008449056B2

(12) United States Patent
Kitakami et al.

(10) Patent No.: US 8,449,056 B2
(45) Date of Patent: May 28, 2013

(54) DRIVING METHOD OF LIQUID DISCHARGE HEAD AND LIQUID DISCHARGE APPARATUS

(75) Inventors: Koichi Kitakami, Chigasaki (JP); Naoto Sasagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 12/889,181

(22) Filed: Sep. 23, 2010

(65) Prior Publication Data

US 2011/0074845 A1 Mar. 31, 2011

(30) Foreign Application Priority Data

Sep. 28, 2009 (JP) ..... 2009-222571
Nov. 18, 2009 (JP) ..... 2009-263016

(51) Int. Cl.
*B41J 29/38* (2006.01)
*B41J 2/045* (2006.01)

(52) U.S. Cl.
CPC .. *B41J 29/38* (2013.01); *B41J 2/045* (2013.01)
USPC ..... 347/9; 347/68; 347/70

(58) Field of Classification Search
None
See application file for complete search history.

(56) References Cited

U.S. PATENT DOCUMENTS

2008/0074474 A1* 3/2008 Yoo et al. ..... 347/70

FOREIGN PATENT DOCUMENTS

| | | | |
|---|---|---|---|
| JP | 2001-253071 | * | 9/2001 |
| JP | 2001-253071 A | | 9/2001 |
| JP | 2008-155537 | * | 7/2008 |
| JP | 2008-155537 A | | 7/2008 |

* cited by examiner

*Primary Examiner* — Geoffrey Mruk
(74) *Attorney, Agent, or Firm* — Canon USA Inc IP Division

(57) ABSTRACT

A driving method of a liquid discharge head including discharge ports, flow paths communicated with the discharge ports, a first actuator provided on the flow paths, a second actuator provided at a position further from the discharge port than the first actuator of the flow paths, and a common liquid chamber communicated with the flow paths, includes: contracting the flow path and expanding the flow path by the first actuator to discharge liquid from the discharge port; starting contraction of the flow path the second actuator when or before flow of liquid from the common liquid chamber to the discharge port in the vicinity of the second actuator, disappears to allow a meniscus of liquid, located at an inner position of the flow path, to project from the discharge port; and starting expansion of the flow path by the second actuator while the meniscus projects from the discharge port.

4 Claims, 9 Drawing Sheets

DRIVING METHOD OF LIQUID DISCHARGE HEAD AND LIQUID DISCHARGE APPARATUS

BACKGROUND OF THE INVENTION

1. Field of the Invention

The present invention relates to a driving method of a liquid discharge head using an actuator as a source for generating liquid discharge energy, and a liquid discharge apparatus including the liquid discharge head using the actuator as the source for generating liquid discharge energy. The present invention can be applied to a printing apparatus for printing text or images on paper, fabric, leather, or nonwoven fabric, and a patterning apparatus or coating apparatus for applying liquid to a substrate, plate material, solid object or the like.

2. Description of the Related Art

Various proposals have been made for a liquid discharge head mounted in a liquid discharge apparatus which can be represented by an ink jet recording apparatus. Particularly, a liquid discharge head using an actuator as a source for generating liquid discharge energy has a merit in that any type of liquid (ink) is suitable for discharge.

Recently, in order to reduce deformation (curling or cockling) of a recording medium due to water contained in ink that is discharged from the liquid discharge head, use of high-viscosity ink with a reduced amount of water in the ink has been considered.

On the other hand, the method of using a piezo head which is a representative example of the actuator used as source for generating liquid discharge energy include "pull-shot" and "push-shot". The former is a discharge method of expanding individual liquid chambers and then contracting them and the latter is a discharge method of contracting the individual liquid chambers and then expanding them.

In the case of discharge of the high-viscosity ink, in terms of a reduction in loss of discharge energy, the "push-shot" is desirable.

A technique is disclosed in Japanese Patent Application Laid-Open No. 2008-155537 for enhancing a refilling ability by providing a second piezoelectric element while employing the push-shot method and simultaneously enhancing discharge efficiency thereby enabling high-frequency discharge of high-viscosity ink.

In addition, a technique is disclosed in Japanese Patent Application Laid-Open No. 2001-253071 for reducing a time to refilling ink by providing a second piezoelectric element while employing the push-shot method.

However, when the description of Japanese Patent Application Laid-Open No. 2008-155537 is examined thoroughly, there are many unclear points on whether the refilling ability is enhanced. That is, in the technique disclosed in Japanese Patent Application Laid-Open No. 2008-155537, first, a voltage applied to a first piezoelectric element is increased to contract the individual liquid chambers to discharge liquid droplets. Thereafter, the voltage applied to the first piezoelectric element is returned to its initial value to expand the contracted individual liquid chambers and thus refilling the liquid chambers with ink (drawing in ink) from a common liquid chamber. However, during the refilling with ink from the common liquid chamber, a meniscus in a discharge port is pulled back in the direction of the common liquid chamber. Moreover, in Japanese Patent Application Laid-Open No. 2008-155537, with the start of the operation for expanding the individual liquid chambers, a cross-section of a flow path is expanded by reducing a voltage applied to the second piezoelectric element, so as to enhance refilling efficiency of the ink from the common liquid chamber (drawing of ink).

However, right after this, the voltage applied to the second piezoelectric element is returned to its initial value so as to contract the expanded cross-section of the flow path. In regard to this, in Japanese Patent Application Laid-Open No. 2008-155537, it is described that ink is pushed into the individual liquid chambers by contracting the cross-section of the flow path and thus it is efficient.

On the examination by the inventors, since the second piezoelectric element is provided at a position close to the common liquid chamber with a small flow resistance, most of the ink is pushed back in the direction of the common liquid chamber rather than to the individual liquid chambers by the operation of contracting the cross-section of the flow path. Accordingly, it is thought that the increase in efficiency of the refilling ability of the individual liquid chambers cannot be expected.

In addition, in the technique disclosed in Japanese Patent Application Laid-Open No. 2008-155537, it is unclear whether the meniscus can be promptly returned to its initial position in the discharge port. If the meniscus is not promptly returned, speedup of drive frequency cannot be realized.

Next, when the description of Japanese Patent Application Laid-Open No. 2001-253071 is examined thoroughly, there are many unclear points on whether the refilling time is reduced. That is, in the technique disclosed in Japanese Patent Application Laid-Open No. 2001-253071, the voltage applied to the second piezoelectric element close to the common liquid chamber is increased in advance to contract the cross-section of the flow path. Subsequently, the voltage applied to the first piezoelectric element is increased to contract the individual liquid chambers and discharge liquid droplets, and then the voltage applied to the second piezoelectric element is returned to its initial value so the cross-section of the contracted flow path is expanded and ink is refilled (ink is drawn in) from the common liquid chamber. In addition, after the operation for expanding the cross-section of the flow path, the voltage applied to the first piezoelectric element is returned to its initial value to expand the contracted individual liquid chambers. In Japanese Patent Application Laid-Open No. 2001-253071, the refilling flow by the second piezoelectric element is added to the refilling flow by the first piezoelectric element by the above-described operation, and thus the efficiency of the refilling ability (drawing of ink) is raised.

However, in the final operation of allowing expansion by the first piezoelectric element, there is a flow which returns the meniscus to the side of the common liquid chamber during the returning process in the discharge direction. As a result, it is thought that the increase in efficiency of the refilling ability of the individual liquid chambers cannot be expected.

In addition, it is unclear whether the meniscus can be promptly returned to its initial position in the discharge port. If the meniscus is not promptly returned, speedup of drive frequency cannot be realized.

SUMMARY OF THE INVENTION

In order to solve the above problems, an object of the invention is to quickly return a meniscus to its initial position after liquid is discharged thereby realizing speedup of drive frequency.

According to an aspect of the invention, there is provided a driving method of a liquid discharge head which includes a discharge port, a flow path that is communicated with the discharge port, a first actuator provided on the flow path, a second actuator provided at a position further from the discharge port than the first actuator on the flow path, and a common liquid chamber that is communicated with the flow path, the driving method including: (1) contracting the flow path and then expanding the flow path by the first actuator to discharge liquid from the discharge port; (2) starting contraction of the flow path by the second actuator when or before the flow of liquid directed from the common liquid chamber to the discharge port in the flow path in a vicinity of the second actuator, disappears to allow a meniscus of the liquid, which is located at an inner position of the flow path, to project outward from the discharge port; and (3) starting the expansion of the flow path by the second actuator while the meniscus of liquid projects outward from the discharge port.

According to another aspect of the invention, there is provided a driving method of a liquid discharge head which includes a discharge port, a flow path that is communicated with the discharge port, a first actuator provided on the flow path, a second actuator provided at a position further from the discharge port than the first actuator on the flow path, and a common liquid chamber that is communicated with the flow path, the driving method including: (1) contracting the flow path and then expanding the flow path by the first actuator to discharge liquid from the discharge port; (2) starting the contraction of the flow path by the second actuator after the start of the expansion of the flow path by the first actuator and on or before the termination of the expansion to allow a meniscus of liquid, which is located at an inner position of the flow path, to project outward from the discharge port; and (3) starting the expansion of the flow path by the second actuator while the meniscus of liquid projects outward from the discharge port.

According to another aspect of the invention, there is provided a liquid discharge apparatus having a liquid discharge head and a control unit, the liquid discharge head including a discharge port for discharging liquid, a flow path that is communicated with the discharge port, a first actuator provided on the flow path, a second actuator provided at a position further from the discharge port than the first actuator on the flow path, and a common liquid chamber that is communicated with the flow path. The control unit contracts the flow path by the first actuator and then expands the flow path by the first actuator to discharge liquid from the discharge port, starts the contracting of flow path by the second actuator when or before the flow of liquid directed from the common liquid chamber to the discharge port in the vicinity of the second actuator, disappears to allow a meniscus of the liquid, which is located at an inner position of the flow path, to project outward from the discharge port, and starts the expansion of the flow path by the second actuator while the meniscus of liquid projects outward from the discharge port.

According to another aspect of the invention, there is provided a liquid discharge apparatus having a liquid discharge head and a control unit, the liquid discharge head including a discharge port for discharging liquid, a flow path that is communicated with the discharge port, a first actuator provided on the flow path, a second actuator provided at a position further from the discharge port than the first actuator on the flow path, and a common liquid chamber that is communicated with the flow path. The control unit contracts the flow path by the first actuator and then expands the flow path by the first actuator to discharge liquid from the discharge port; starts the contracting of the flow path by the second actuator after the start of the expansion of the flow path by the first actuator and on or before the termination of the expansion to allow a meniscus of liquid, which is located at an inner position of the flow path, to project outward from the discharge port, and starts the expansion of the flow path by the second actuator while the meniscus of liquid projects outward from the discharge port.

According to the aspects of the invention, the meniscus quickly can be returned to its initial position after the liquid is discharged, thereby realizing the speedup of the drive frequency.

Further features of the present invention will become apparent from the following description of exemplary embodiments with reference to the attached drawings.

BRIEF DESCRIPTION OF THE DRAWINGS

FIG. 1A is a cutaway perspective view and FIG. 1B is a block diagram.

FIG. 2A is a plan view, and FIG. 2B is a cross-sectional view.

DESCRIPTION OF THE EMBODIMENTS

Preferred embodiments of the present invention will now be described in detail in accordance with the accompanying drawings.

Figure 1A:
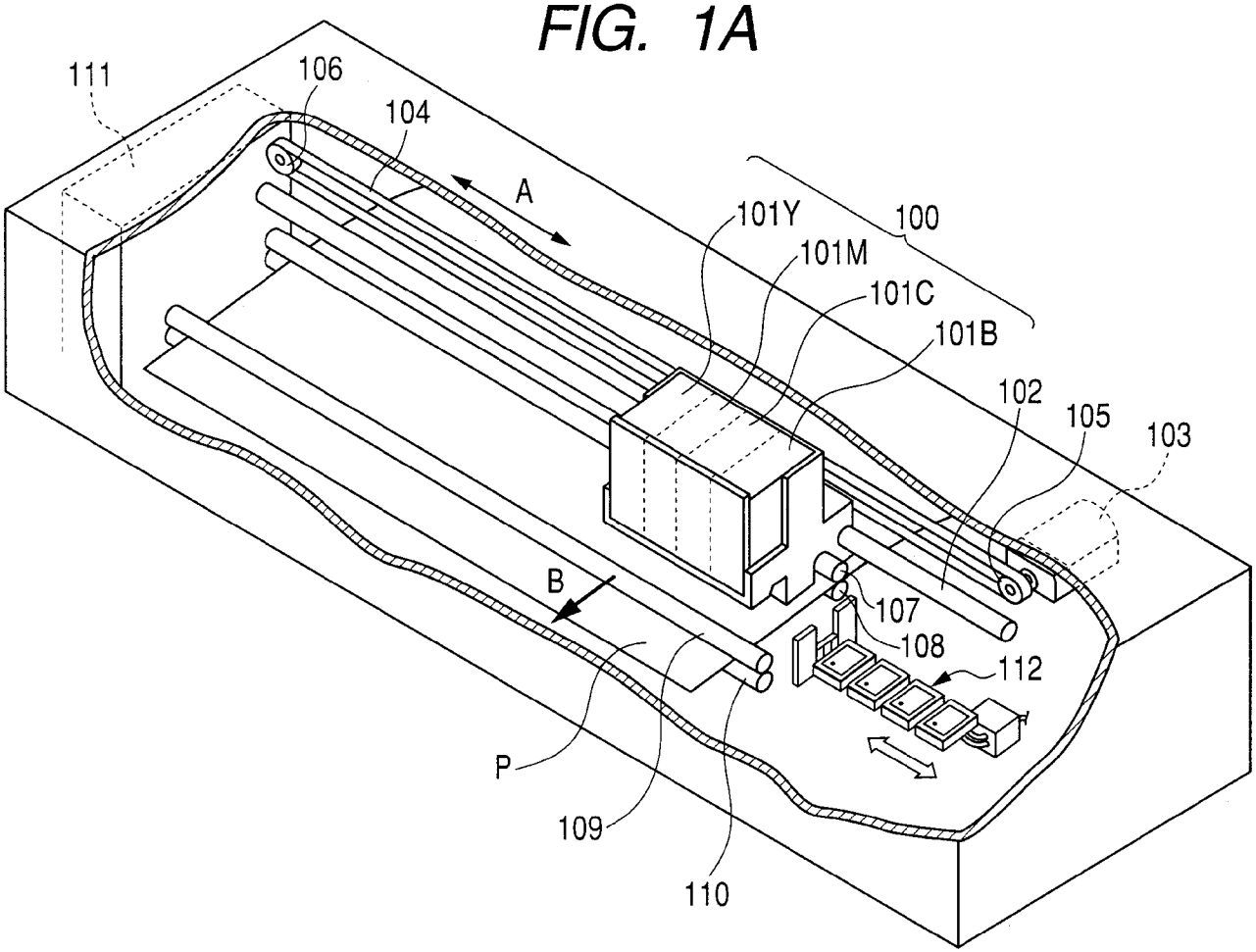
FIGS. 1A and 1B illustrate a liquid discharge apparatus according to an embodiment the invention, where

Hereinafter, a driving method of a liquid discharge head according to an embodiment of the invention will be described in detail with reference to the accompanying drawings. FIG. 1A is a perspective view of a liquid discharge apparatus according to the embodiment of the invention. A recording medium P supplied to the illustrated liquid discharge apparatus is conveyed to a recordable area of a liquid discharge head unit 100 by feed rollers 109 and 110. The liquid discharge head unit 100 is guided by two guide shafts 102 and 107 to be movable along the extension direction so as to scan a recording area while reciprocating. A scanning direction of the liquid discharge head unit 100 is a main scanning direction, and a conveying direction of the recording medium P is a sub scanning direction. Mounted in the liquid discharge head unit 100 are liquid discharge heads 1 for discharging plural colors of liquid ink droplets and ink tanks 101 for supplying ink respectively to the liquid discharge heads 1. According to this embodiment, an ink tank 101B for black (Bk), an ink tank 101C for cyan (C), an ink tank 101M for magenta (M), and an ink tank 101Y for yellow (Y), that is, four ink tanks are mounted. In addition, the ink tanks 101 are positioned in a random order.

Figure 1B:
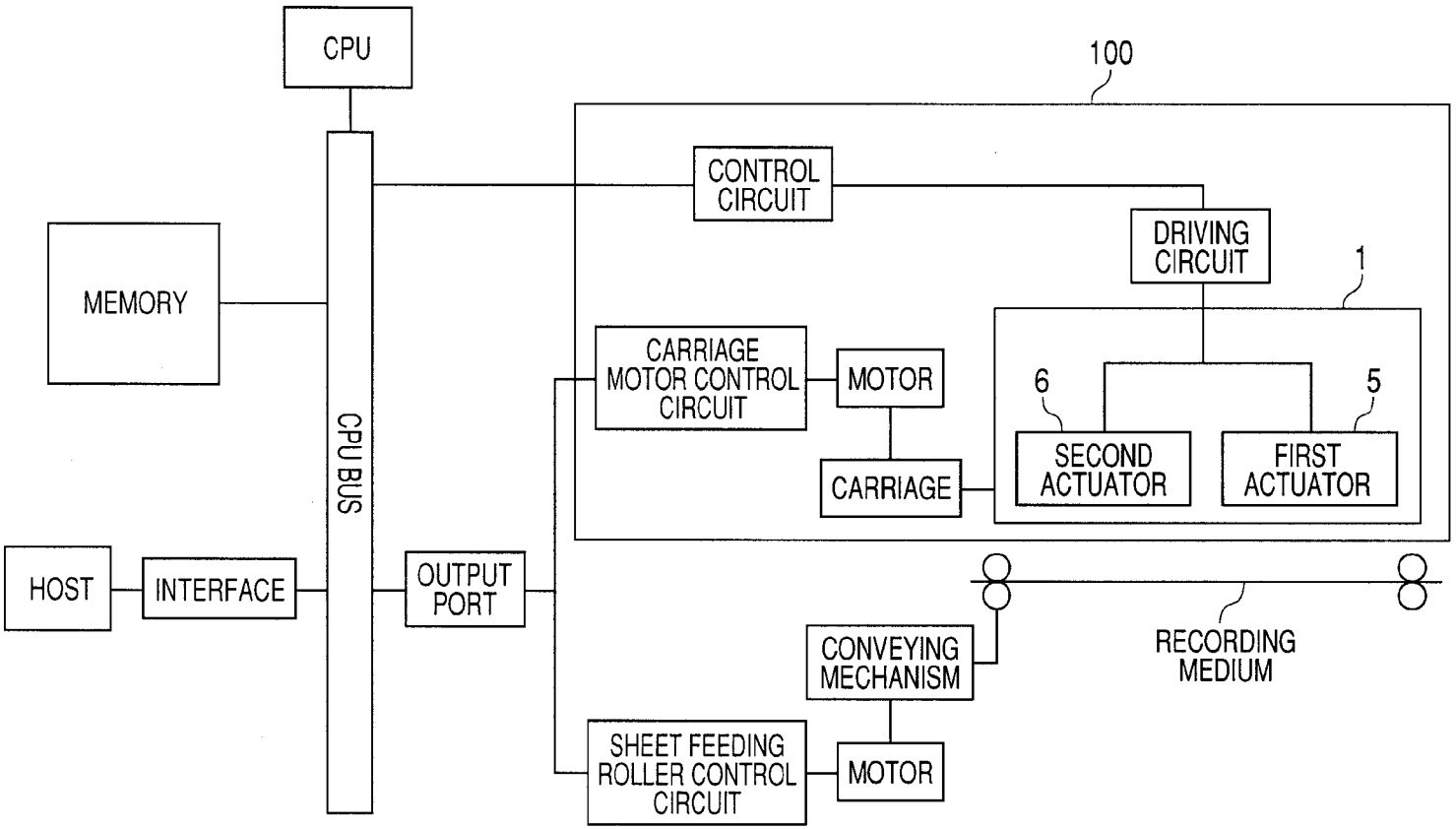

FIG. 1B is a block diagram for describing a configuration of the liquid discharge apparatus according to the embodiment of the invention. A CPU configured as a microprocessor is connected to a host via an interface and controls recording operations based on information stored in a memory. The CPU moves a carriage by operating a carriage motor via an output port and a carriage motor control circuit. In addition, the CPU operates a conveying mechanism such as a conveying roller by operating a sheet feeding motor via the output port and a sheet feeding motor control circuit. Moreover, the CPU drives a first actuator 5 and a second actuator 6 of the liquid discharge head 1 via a control circuit and a driving circuit based on recording information stored in the memory, thereby recording a desired image on the recording medium.

At a lower portion of an end of the area where the liquid discharge head unit 100 is movable, a recovery system unit 112 is disposed to perform a recovery process on a discharge port part of the liquid discharge head 1 during a non-recording operation.

Figure 2A:
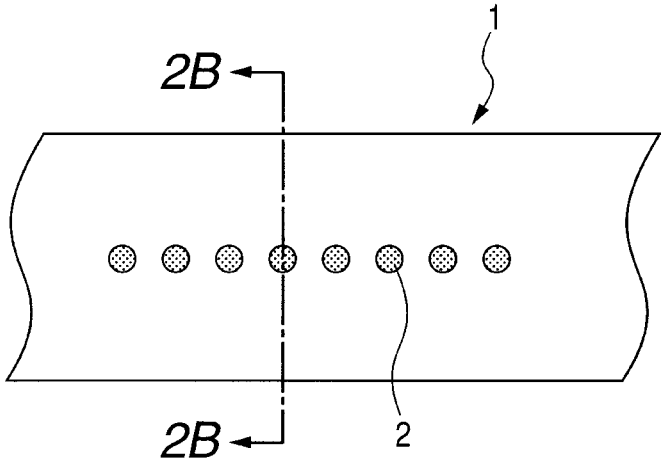
FIGS. 2A and 2B illustrate a liquid discharge head, where
Figure 2B:
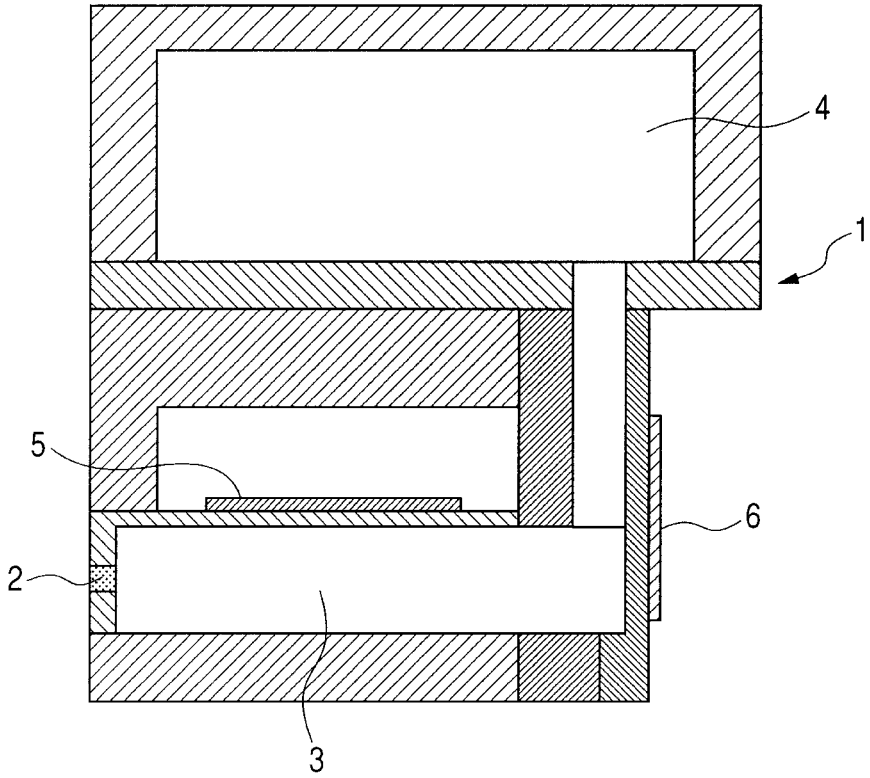

FIG. 2A is a plan view of the liquid discharge head 1. FIG. 2B is a cross-sectional view of the liquid discharge head 1 and illustrates a cross-section taken along the line 2B to 2B of FIG. 2A. That is, the cross-section including a discharge port 2 is illustrated.

In the illustrated liquid discharge head 1, first and second actuators 5 and 6 including, for example, piezoelectric elements are disposed along a flow path 3 which is communicated with each discharge port 2. The liquid discharge head 1 discharges liquid droplets from the discharge port 2 by drive voltages being independently applied to the actuators 5 and 6. In addition, each of the actuators 5 and 6 is provided with an electrode wire (not shown) to be supplied with the drive voltage.

A part of the flow path 3 which extends in the same direction as a center axis of the discharge port 2 has a shape of a rectangular parallelepiped (prismatic column) with a length of 6,000 μm, a width of 100 μm, and a height of 200 μm. In addition, a part of the flow path 3 which extends in a direction perpendicular to the center axis of the discharge port 2 has a length of 800 μm, a width of 100 μm, and a height of 200 μm. The length of the part thereof which extends in the direction perpendicular to the center axis of the discharge port 2 refers to a length from a curved part to a connection part of a common liquid chamber 4. This part is provided with a squeezed portion (not shown) with a width of 15 μm.

As in FIG. 2B, it is apparent that the first actuator 5 is provided along a longitudinal direction of the part of the flow path 3 which extends in the same direction as the center axis of the discharge port 2. In other words, the first actuator 5 is provided along the longitudinal direction of the prismatic column. In addition, it is also apparent that the second actuator 6 is provided along a longitudinal direction of the part of the flow path 3 which extends in the direction perpendicular to the center axis of the discharge port 2. In other words, the second actuator 6 is provided along a surface perpendicular to the longitudinal direction of the prismatic column.

Example 1

Examples of the invention will be described in detail. In this example, the liquid discharge head 1 illustrated in FIGS. 2A and 2B was manufactured. The discharge port 2 is a circular hole with a diameter of 10 μm and an orifice plate thickness of 15 μm. Liquid to be discharged is clear ink (with 66% PEG600, 33% pure water, and 1% surfactant) and has a viscosity of $40\times10^{-3}$ [Ps·s] and a surface tension of $38\times10^{-3}$ [N/m] (both are values at room temperature).

Figures 3A, 3B, 3C:
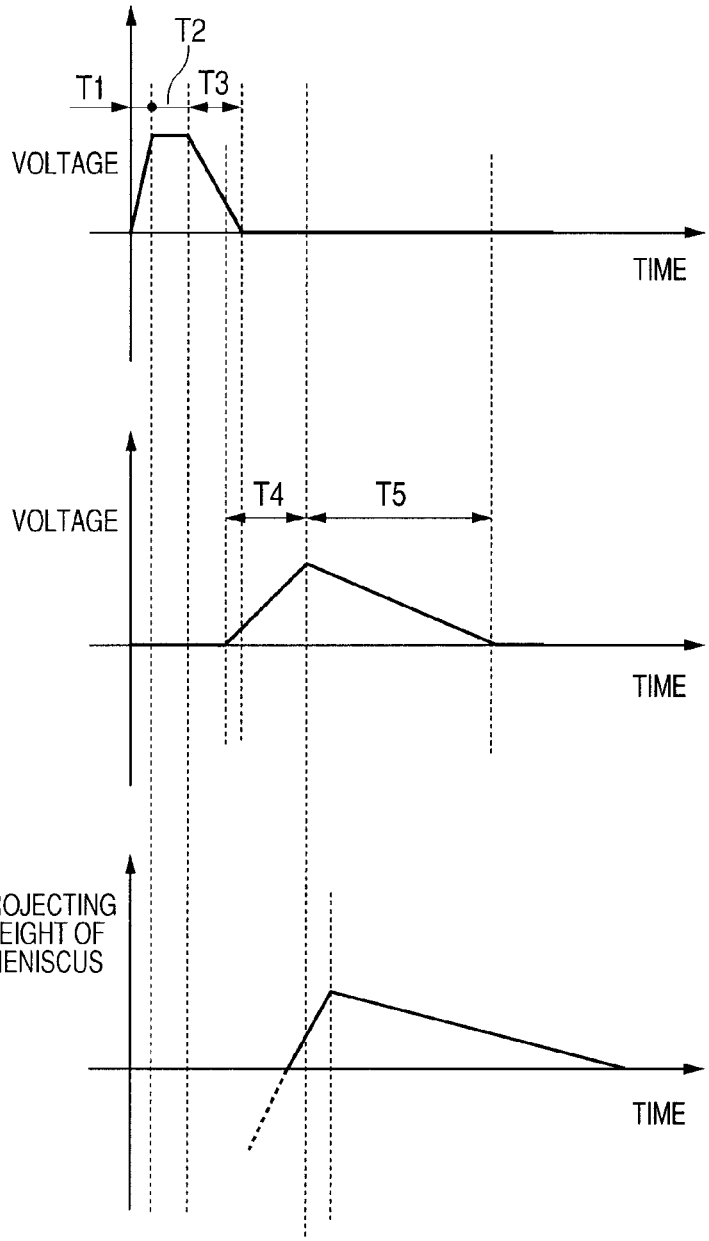
FIG. 3A is a diagram illustrating a voltage waveform applied to a first actuator.
FIG. 3B is a diagram illustrating a voltage waveform applied to a second actuator.
FIG. 3C is a diagram illustrating a projecting height of a meniscus after discharge of liquid droplets.

This example is for the purpose of discharging high-viscosity ink. Therefore, in order to reduce loss of discharge energy as much as possible, the push-shot method is employed. FIG. 3A is a diagram illustrating a voltage waveform applied to the first actuator 5, and FIG. 3B is a diagram illustrating a voltage waveform applied to the second actuator 6. In addition, FIG. 3C is a graph showing a height of a meniscus of the liquid, which has been drawn into the discharge port 2 once after ink droplets are discharged from the discharge port 2, projecting toward the outside.

In the waveform diagrams of FIGS. 3A and 3B, horizontal axes represent time and vertical axes represent voltage. As the voltage is increased, the flow path 3 illustrated in FIG. 2B contracts, and as the voltage is decreased, the flow path 3 expands compared to the state at that time. In the waveform diagrams of FIGS. 3A and 3B, in a period in which the voltage is raised from its initial position (T1 period), the flow path 3 contracts, and in a period in which the voltage is lowered (T3 period), the flow path 3 expands.

In addition, in FIGS. 3A to 3C, minute vibrations caused by a coupled motion of the actuators and the fluid are omitted, and only whether the flow path 3 contracts or expands is focused on.

First, as the voltage applied to the first actuator 5 illustrated in FIG. 2B is increased, the flow path 3 contract in the T1 period in FIG. 3A and a liquid column projects to the outside. Thereafter, if the flow path 3 is not contracted as the voltage applied to the first actuator 5 is held as is in a T2 period in FIG. 3A, the liquid column is cut. There are cases where cut liquid column does not become liquid droplets due to its high viscosity and generates a single liquid droplet and cases where a plurality of liquid droplets are generated. A discharge amount was 1 picoliter.

In addition, cutting of the liquid column may be controlled to be performed during the operation of expanding the flow path 3 in a T3 period in FIG. 3A.

Figure 4A:
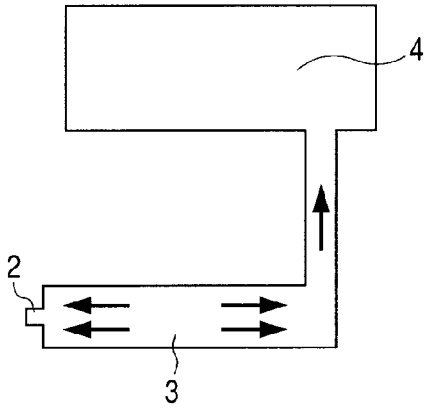
FIGS. 4A, 4B, 4C and 4D are cross-sectional views schematically illustrating flows in a flow path.

An outline of the flows in the flow path 3 between the T1 and T2 periods are shown in FIG. 4A. Since the flow path 3 is contracted by the first actuator 5 (FIG. 2B), there is a flow toward the discharge port 2 and a flow toward the common liquid chamber 4. In addition, the flow toward the discharge port 2 contributes to the discharging of the liquid droplets.

Figure 5A:
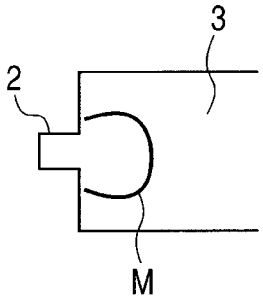
FIGS. 5A, 5B, 5C, 5D and 5E are cross-sectional views schematically illustrating positions of a meniscus of liquid.

After the liquid column is cut, as illustrated in FIG. 5A, a meniscus M of liquid is formed in a state of being drawn into the flow path 3. Since a position of the meniscus M at this time point is in the flow path 3, a depth thereof cannot be measured. Therefore, in FIG. 3C, the depth is indicated by a long dotted line.

Next, the voltage applied to the first actuator 5 (FIG. 2B) is returned to its initial state. Accordingly, the flow path 3 expands in the T3 period in FIG. 3A.

Figure 4C:
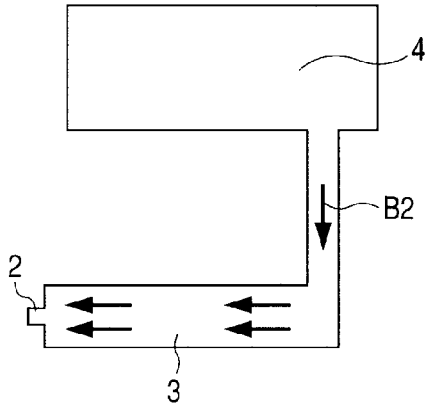
Figure 4B:
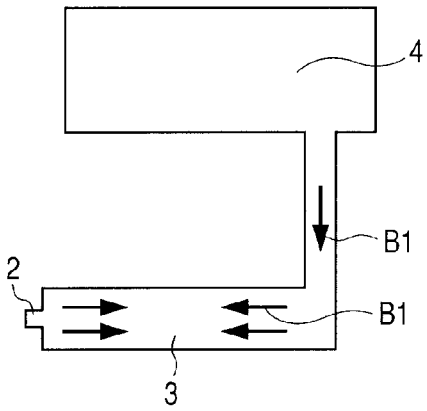

An outline of the flows in the flow path 3 in the T3 period are illustrated in FIG. 4B. Since the flow path 3 is expanded by the first actuator 5 (FIG. 2B), there is a flow from the discharge port 2 and a flow from the common liquid chamber 4 (arrows B1 in FIG. 4B).

Figure 5D:
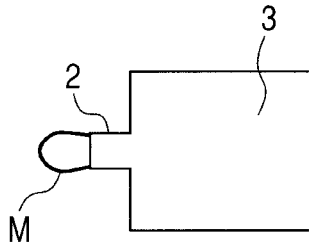
Figure 5B:
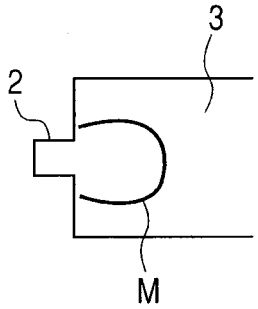

In the T3 period, as illustrated in FIG. 5B, the meniscus M is drawn further into the flow path 3.

Figure 5E:
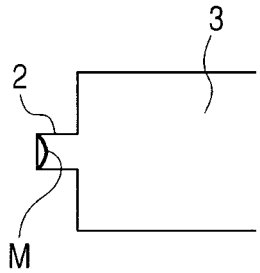
Figure 5C:
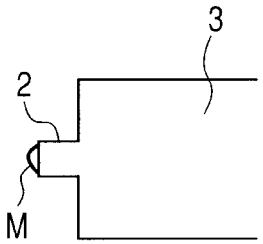

Next, as the voltage applied to the second actuator 6 (FIG. 2B) is increased, the flow path 3 contracts in a T4 period in FIG. 3B. This timing may occur while the flow (arrows B1 in FIG. 4B) is formed from the common liquid chamber 4 due to the expansion of the flow path 3 by the first actuator 5 (FIG. 2B). That is, the contraction of the flow path 3 by the second actuator 6 may be started when or before the flow, which is toward the discharge port 2 from the common liquid chamber 4 and occurs in the vicinity of the second actuator 6, disappears. Accordingly, the flow from the common liquid chamber 4 (the arrows B1 of FIG. 4B) can be added to the flow by the second actuator 6 (FIG. 4C), so that the meniscus M can be quickly returned to the discharge port 2 as illustrated in FIG. 5C.

Since the contraction of the second actuator 6 (FIG. 2B) at this time is in the order of tens to hundreds of nanometers, it is confirmed that the flow indicated by the arrows B1 in FIG. 4B does not disappear and the flow toward the discharge port 2, as the flow indicated by arrows B2 in FIG. 4C, can be maintained. The confirmation is achieved by a 3D unsteady fluid simulation.

In this example, the T4 period is started in the T3 period in FIG. 3A and from 5 μs before the termination of the T3 period. That is, the contraction of the flow path 3 by the second actuator 6 is started after the start of the expansion of the flow path 3 by the first actuator 5 illustrated in FIG. 2B and on or before the termination of the expansion thereof.

As the flow path 3 is contracted in the T4 period in FIG. 3B by the second actuator 6 (FIG. 2B), as illustrated in FIG. 5D, the meniscus M (liquid column) formed at more of an inner position than the discharge port 2 is allowed to project outward (toward the outside) significantly (FIG. 3C). In this example, since ink with high viscosity was used, even in this operation, the liquid column was not cut or liquid droplets were not cut nor scattered from the liquid column.

Figure 4D:
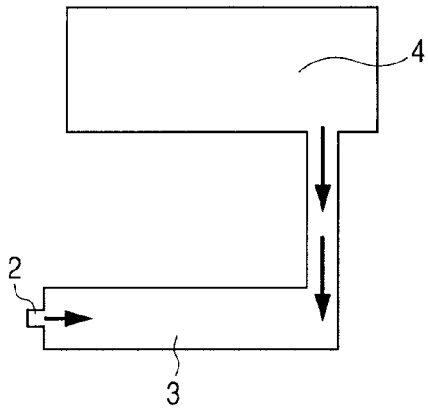

Last, the voltage applied to the second actuator 6 (FIG. 2B) is returned to its initial state. Accordingly, the flow path 3 expands in a T5 period in FIG. 3B. As a result, there is a flow from the discharge port 2 and a flow from the common liquid chamber 4 (FIG. 4D). At the discharge port 2, as illustrated in FIG. 5D, the meniscus M (liquid column) with high viscosity projects outward, and thus flow resistance is extremely high, so that the meniscus M (liquid column) with high viscosity is slowly drawn into the flow path 3. Consequently, high-viscosity ink is refilled from the common liquid chamber 4 having relatively low flow resistance with high efficiency.

As a result, time taken to return the meniscus M to its initial position was later than 80 μs from the start of the operation illustrated in FIG. 3A (a drive frequency of 12.5 kHz).

Figure 6:
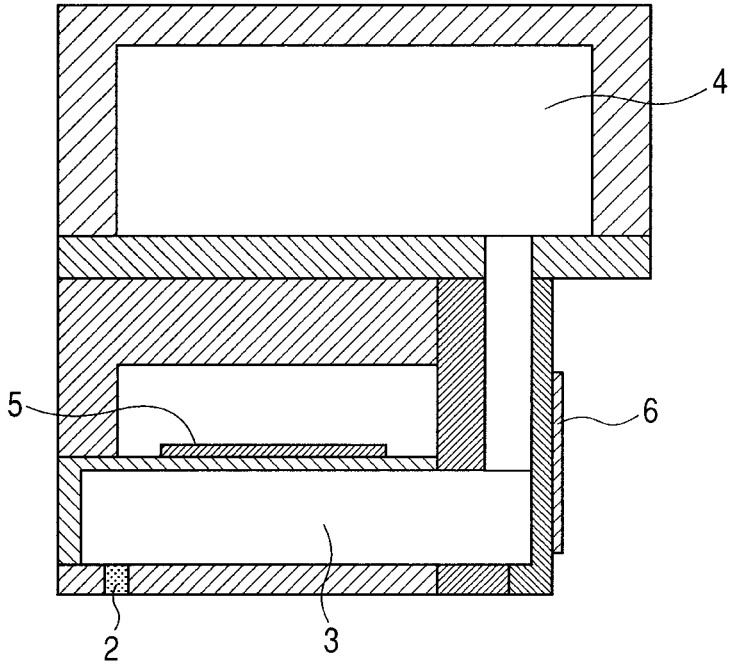
FIG. 6 is a cross-sectional view illustrating a liquid discharge head according to another embodiment of the invention.

The head in which the discharge port 2 is provided at the position illustrated in FIG. 2B, that is, the position to allow liquid to flow along the flow path, has been exemplified. However, as illustrated in FIG. 6, the same result can be obtained even a head in which the discharge port 2 is formed at a lower side, that is, the discharged port 2 is provided to be perpendicular to a direction in which liquid flows through the flow path.

Example 2

Next, another example of the invention will be described. The liquid discharge head 1 used in this example is the same as that used in Example 1. The same clear ink to be discharged is used. Therefore, in the following description, description of common factors to Example 1 will be omitted.

In this example, the T4 period in FIG. 3B was started at the same time as the termination of the T3 period in FIG. 3A.

As the flow path 3 is contracted by the second actuator 6 (FIG. 2B) in the T4 period in FIG. 3B, as illustrated in FIG. 5D, the meniscus M (liquid column) is allowed to significantly project outward (toward the outside) (FIG. 3C). In this example, since ink with high viscosity is used, even in this operation, the liquid column was not cut, liquid droplets were not cut nor scattered from the liquid column.

Last, the voltage applied to the second actuator 6 (FIG. 2B) is returned to its initial state. Accordingly, the flow path 3 expands in the T5 period in FIG. 3B. As a result, there is a flow from the discharge port 2 and a flow from the common liquid chamber 4 (FIG. 4D). At the discharge port 2, as illustrated in FIG. 5D, the meniscus M (liquid column) with high viscosity projects outward, and thus flow resistance is extremely high, so that the meniscus M (liquid column) with high viscosity is slowly drawn into the flow path 3 (FIG. 5E). Consequently, high-viscosity ink is refilled from the common liquid chamber 4 having relatively low flow resistance with high efficiency.

As a result, time taken to return the meniscus M to its initial position was later than 85 μs from the start of the operation illustrated in FIG. 3A (a drive frequency of 11.8 kHz).

The operations of the liquid discharge head described above, particularly, the operations of the first and second actuators are controlled by a control unit provided in the liquid discharge apparatus with the liquid discharge head.

Example 3

Figure 7:
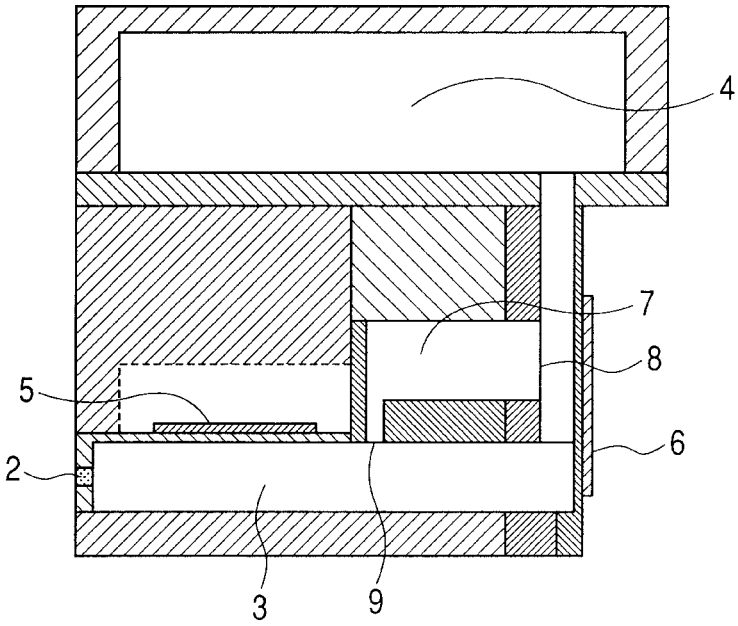
FIG. 7 is a cross-sectional view illustrating a liquid discharge head according to further another embodiment of the invention.

Further another example of the invention will now be described. Clear ink to be discharged in this example is the same as that used in Example 1. FIG. 7 is a diagram schematically illustrating the liquid discharge head 1 according to this example. The discharge port 2 is a circular hole with a diameter of 10 μm and an orifice plate thickness of 15 μm. In the following description, description of common factors to Example 1 will be omitted.

A part of the flow path 3 illustrated in FIG. 7 which extends in the same direction as the center axis of the discharge port 2 has a length of 6,000 μm, a width of 100 μm, and a height of 200 μm. The flow path 3 from the curved part to the connection part of the common liquid chamber 4 has a length of 1,200 μm, a width of 100 μm, and a height of 200 μm, and a portion of which is provided with a squeezed portion with a width of 15 μm. An opening area of a first opening 8 is 600 μm×100 μm, and an opening area of a second opening 9 is 100 μm×100 μm.

In general, it is known that a structure in which a cross-sectional area of a flow path rapidly changes has a function of a fluid diode. In this example, with regard to a second flow path 7, since there is a large difference between the opening area of the first opening 8 and the opening area of the second opening 9, the second flow path 7 shows characteristics of a fluid diode.

Figure 8A:
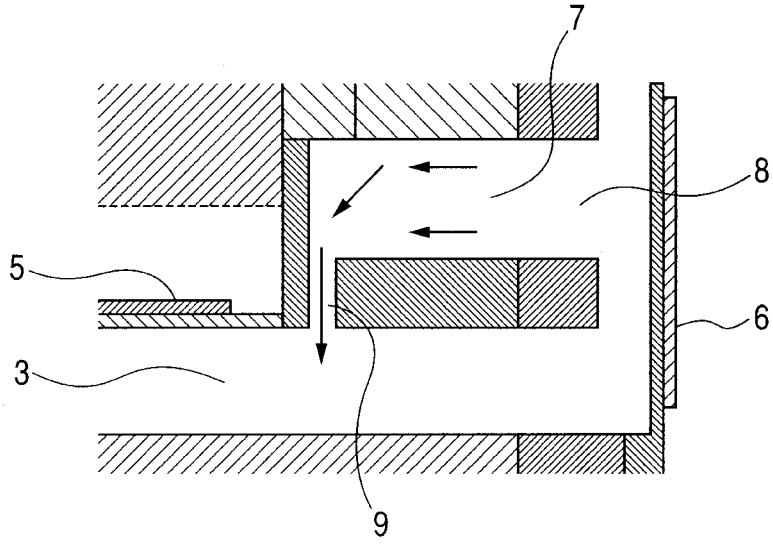
FIGS. 8A and 8B are diagrams for describing effects of a second flow path.
Figure 8B:
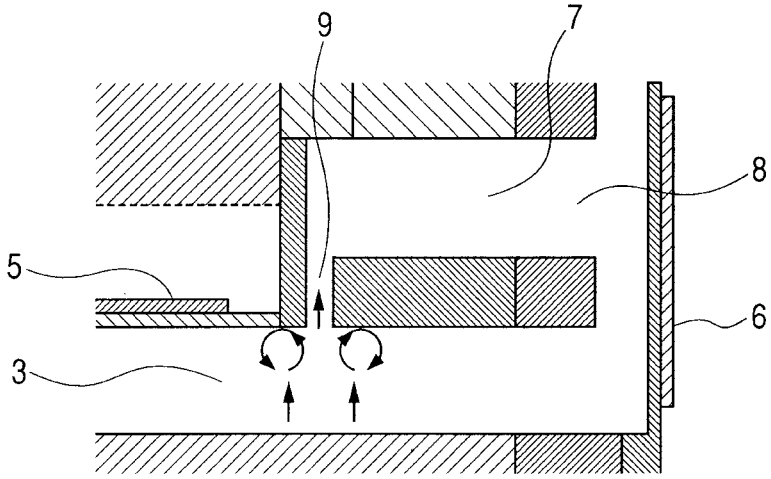

As illustrated in FIG. 8A, when liquid flows from the first opening 8 to the second opening 9 through the second flow path 7, the liquid is smoothly introduced to the second opening 9. With regard to this, as illustrated in FIG. 8B, when liquid flows from the second opening 9 to the first opening 8, since the second opening 9 is narrow, the flow hits up against wall surfaces in the vicinity of the second opening 9 and because of this turbulent flow is generated, it becomes difficult for the liquid to flow into the second flow path 7. As a result, the second flow path 7 exhibits the fluid diode characteristics in that the liquid easily flows from the first opening 8 to the second flow path 7 but flow from the second opening 9 to the second flow path 7 is difficult.

Effects of the second flow path 7 are described with reference to FIGS. 9A to 9D. The first and second actuators 5 and 6 were driven as respectively illustrated in FIGS. 3A and 3B.

First, as the voltage applied to the first actuator 5 is increased, the flow path 3 is contracted in the T1 period in FIG. 3A such that the liquid column projects toward the outside. Thereafter, if the flow path 3 is not contracted as the applied voltage is held as in the T2 period in FIG. 3A, the liquid column is cut. The discharge amount was 1 picoliter. In addition, the cutting of the liquid column may be controlled to be performed during the operation of expanding the flow path 3 in the T3 period in FIG. 3A.

Figure 9A:
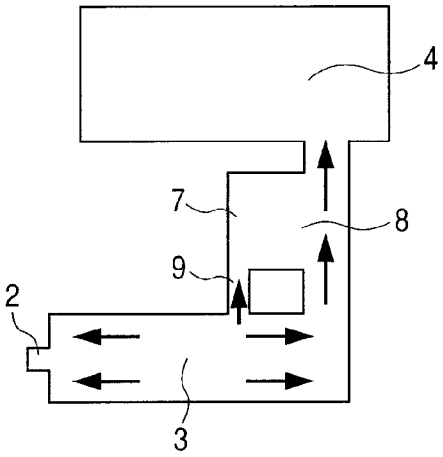
FIGS. 9A, 9B, 9C and 9D are cross-sectional views schematically illustrating flows in a flow path in the liquid discharge head according to the further another embodiment of the invention.

An outline of the flows in the flow paths 3 and 7 in the T1 and T2 periods are shown in FIG. 9A. Since the flow path 3 is contracted by the first actuator 5, there is a flow toward the discharge port 2 and a flow toward the common liquid chamber 4. In addition, the flow toward the discharge port 2 contributes to the discharging of the liquid droplets.

Since the second flow path 7 has a structure in which it is difficult for liquid to flow into the second flow path 7 from the second opening 9, the flow toward the discharge port 2 is hardly affected.

Next, the voltage applied to the first actuator 5 is returned to its initial state. Accordingly, the flow path 3 expands in the T3 period in FIG. 3A. An outline of the flows in the flow paths 3 and 7 in the T3 period are illustrated in FIG. 9B. Since the flow path 3 is expanded by the first actuator 5, there is a flow from the discharge port 2 and a flow from the common liquid chamber 4 (C1 in FIG. 9B). Since liquid easily flows to the second flow path 7 from the first opening 8, the flow from the common liquid chamber 4 can be strengthened (C1 in FIG. 9B). As a result, as illustrated in FIG. 5B, the meniscus M is drawn further into the flow path 3. However, as the second flow path 7 is provided, an amount that the meniscus M can be drawn in can be reduced compared to that in Example 1.

Next, as the voltage applied to the second actuator 6 is increased, the flow path 3 contracts in the T4 period in FIG. 3B, and thus the meniscus M (liquid column) projects toward the outside significantly as illustrated in FIG. 5D.

In this example, as in Example 1, the T4 period was started during the T3 period in FIG. 3A and from 5 μs before the termination of the T3 period.

Figure 9C:
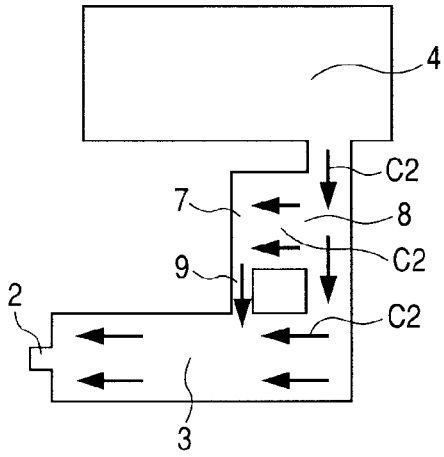
Figure 9B:
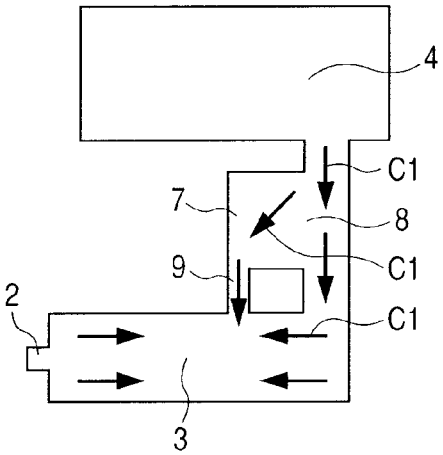

As illustrated in FIG. 9C, as the flow by the second actuator 6 is smoothly introduced to the second opening 9 from the first flow path 8, the flow from the common liquid chamber 4 (C2 in FIG. 9C) is strengthened. Accordingly, the meniscus M can be returned more quickly to the discharge port 2 compared to Example 1.

In addition, since the flow to the discharge port can be strengthened by the second flow path 7, the voltage applied to the second actuator 6 needed to return the meniscus M to the discharge port 2 can be reduced.

Figure 9D:
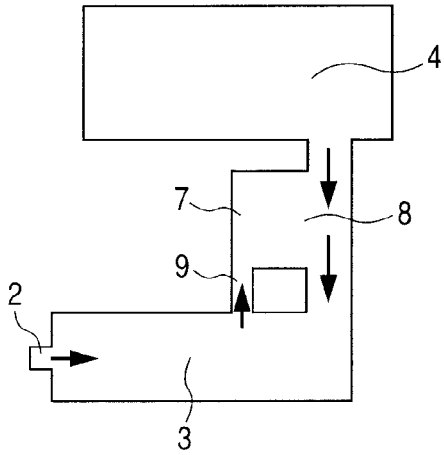

Last, the voltage applied to the second actuator 6 is returned to its initial state. Accordingly, the flow path 3 expands in the T5 period in FIG. 3B. As a result, there is a flow from the discharge port 2 and a flow from the common liquid chamber 4 (FIG. 9D). At the discharge port 2, as illustrated in FIG. 5D, the meniscus M (liquid column) with high viscosity projects to the outside, and thus flow resistance is extremely high, so that the meniscus M (liquid column) with high viscosity is slowly drawn into the flow path 3. Consequently, high-viscosity ink is refilled from the common liquid chamber 4 having relatively low flow resistance with high efficiency. Here, since it is difficult for the liquid to flow to the second flow path 7 from the opening in the vicinity of the discharge port 2, there are hardly any flows in the second flow path 7. Therefore, the drawing of the meniscus M by the second flow path 7 is hardly affected in the T5 period.

As a result, a statically-determinate time of the meniscus at the initial position was later than 70 μs from the start of the operation of FIG. 3A (a drive frequency of 14.2 kHz).

Comparative Example

Next, Comparative Example which is compared to Examples 1 to 3 is described. The liquid discharge head 1 used in Comparative Example is the same as that used in Example 1. The same clear ink to be discharged is used. Therefore, in the following description, description of common factors to Example 1 will be omitted.

In Comparative Example, contrary to Examples 1 and 2, the T4 period was started 4 μs after the termination of the T3 period in FIG. 3B.

As the voltage applied to the second actuator 6 (FIG. 2B) was increased, the flow path 3 contracted in the T4 period in FIG. 3B. However, in Comparative Example, the meniscus M could not be quickly returned to the discharge port 2 by applying the voltage at the same level as that in Example 1.

Here, after the momentum of the flow, which is from the common liquid chamber 4 (B1 in FIG. 4B) due to the expansion of the flow path 3 by the first actuator 5 (FIG. 2B), was lost, the flow path 3 is contracted by the second actuator 6 (FIG. 2B). It is though that for this reason, most of the flow due to the contraction of the second actuator 6 (FIG. 2B) are formed in the direction toward the common liquid chamber 4 which has low fluid resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-222571, filed on Sep. 28, 2009, 2009-263016 filed on Nov. 18, 2009 which are hereby incorporated by reference herein in their entirety.

What is claimed is:

1. A driving method of a liquid discharge head which includes a discharge port for discharging liquid, a flow path that is communicated with the discharge port, a first actuator provided on the flow path, a second actuator provided at a position further from the discharge port than the first actuator on the flow path, and a common liquid chamber that is communicated with the flow path, the driving method comprising:

contracting the flow path and then expanding the flow path by the first actuator to discharge liquid from the discharge port;

starting contraction of the flow path by the second actuator when or before a flow of liquid directed from the common liquid chamber to the discharge port in the flow path in a vicinity of the second actuator, disappears to allow a meniscus of liquid, which is located at an inner position of the flow path, to project outward from the discharge port; and starting the expansion of the flow path by the second actuator while the meniscus of liquid projects outward from the discharge port, wherein, as the liquid discharge head, a liquid discharge head is used which includes a first opening provided in the vicinity of the second actuator so as to be communicated with the flow path, a second opening which is provided at a position closer to the discharge port than the first opening so as to be communicated with the flow path and which has a smaller area than the first opening, and a second flow path which allows the first and second openings to be communicated with each other.

2. The driving method according to claim 1, wherein the liquid discharge head is used in which a part of the flow path that is provided with the first actuator has a shape of a prismatic column including a rectangular parallelepiped, the first actuator is provided along a longitudinal direction of the prismatic column, and the second actuator is provided at least along a surface perpendicular to the longitudinal direction of the prismatic column.

3. A driving method of a liquid discharge head which includes a discharge port for discharging liquid, a flow path that is communicated with the discharge port, a first actuator provided on the flow path, a second actuator provided at a position further from the discharge port than the first actuator on the flow path, and a common liquid chamber that is communicated with the flow path, the driving method comprising:

contracting the flow path and then expanding the flow path by the first actuator to discharge liquid from the discharge port;

starting the contraction of the flow path by the second actuator after the start of the expansion of the flow path by the first actuator and on or before the termination of the expansion to allow a meniscus of liquid, which is located at an inner position of the flow path, to project outward from the discharge port; and starting the expansion of the flow path by the second actuator while the meniscus of liquid projects outward from the discharge port, wherein, as the liquid discharge head, a liquid discharge head is used which includes a first opening provided in the vicinity of the second actuator so as to be communicated with the flow path, a second opening which is provided at a position closer to the discharge port than the first opening so as to be communicated with the flow path and which has a smaller area than the first opening, and a second flow path which allows the first and second openings to be communicated with each other.

4. The driving method according to claim 3, wherein the liquid discharge head is used in which a part of the flow path that is provided with the first actuator has a shape of a prismatic column including a rectangular parallelepiped, the first actuator is provided along a longitudinal direction of the prismatic column, and the second actuator is provided at least along a surface perpendicular to the longitudinal direction of the prismatic column.

* * * * *